US005905470A

United States Patent [19]

Fujii et al.

[11] Patent Number: 5,905,470

[45] Date of Patent: May 18, 1999

[54] VEHICLE SIDE WINDOW GLASS ANTENNA FOR RADIO BROADCAST WAVES

[75] Inventors: Hiroyuki Fujii; Mitsuhisa Maegawa, both of Mie, Japan

[73] Assignee: Central Glass Company, Limited, Yamaguchi, Japan

[21] Appl. No.: 08/995,399

[22] Filed: Dec. 19, 1997

[30] Foreign Application Priority Data

Dec. 20, 1996 [JP] Japan ..... 8-340949

[51] Int. Cl.[6] ..... H01Q 1/32

[52] U.S. Cl. ..... 343/713; 343/711

[58] Field of Search ..... 343/713, 704, 343/711, 712; H01Q 1/32

[56] References Cited

U.S. PATENT DOCUMENTS

| | | | |
|---|---|---|---|
| 4,072,955 | 2/1978 | Comastri et al. | 343/713 |
| 4,527,164 | 7/1985 | Cestaro et al. | 343/713 |
| 4,602,260 | 7/1986 | Lindenmeier et al. | 343/701 |
| 4,727,377 | 2/1988 | Yotsuya et al. | 343/713 |
| 4,967,202 | 10/1990 | Shinnai et al. | 343/713 |

FOREIGN PATENT DOCUMENTS

| | | |
|---|---|---|
| 0 531 734 A1 | 3/1993 | European Pat. Off. . |
| 0 734 091 A2 | 9/1996 | European Pat. Off. . |
| 58-61509 | 4/1983 | Japan . |
| 61-265904 | 11/1986 | Japan . |

*Primary Examiner*—Hoanganh Le

*Attorney, Agent, or Firm*—Evenson, McKeown, Edwards & Lenahan, P.L.L.C.

[57] ABSTRACT

A glass antenna attached to a vehicle side window glass for receiving radio waves such as FM radio broadcast waves and AM radio broadcast waves is provided. The glass antenna comprises a feed point disposed adjacent one of the lateral edges of the window glass, a first vertical element extending upwardly from the feed point along one of the lateral edges to a place adjacent the upper edge of the window glass, a first horizontal element extending from the first vertical element along the upper edge to a nearly central portion of the window glass, a second vertical element extending from the first horizontal element through the nearly central portion to a place adjacent the lower edge of the window glass, a second horizontal element extending from the second vertical element along the lower edge to a place adjacent the other of the lateral edges, and a third vertical element extending upwardly from the second horizontal element along the other of the lateral edges of the window glass.

18 Claims, 6 Drawing Sheets

VEHICLE SIDE WINDOW GLASS ANTENNA FOR RADIO BROADCAST WAVES

BACKGROUND OF THE INVENTION

1. Field of the Invention

The present invention relates to a glass antenna attached to a vehicle side window glass such as for automobiles, particularly of the kind suited for receiving FM radio broadcast waves and AM radio broadcast waves.

2. Description of the Related Art

Examples of glass antennas having been heretofore known and put into practical use are an antenna attached to a marginal area or space of a rear window glass above or below a defogger electric heating element and an antenna including a conductive strip provided to a windshield, the former antenna however being not always capable of attaining a sufficient reception gain since the space occupied by the antenna is required to be small for eliminating the possibility that the antenna makes poor the visibility.

Further, the latter antenna, i.e., the antenna provided to a windshield can attain a relatively high reception gain but is encountered by a larger restriction on its attaching place than the rear window glass so that it never blocks the driver's visibility.

An antenna provided to a vehicle side window glass has come to attract attention since it is not encountered by the above described restriction and an automobile with a large side window such as a recreational vehicle (RV) has come to be used widely, and a number of proposal relating to such an antenna have been made as is disclosed in Japanese utility model provisional publication No. 58-61509 and Japanese patent provisional publication No. 61-265904.

However, most of the proposals relate to an antenna for receiving television (TV) broadcast waves, and there have been little proposals relating to an antenna for receiving FM (Frequency-Modulated) radio broadcast waves and AM (Amplitude Modulation) radio broadcast waves.

Particularly, in case of recreational vehicles (RV), many of their rear windows are capable of opening and closing, so the rear window glass is small-sized, resulting in a small marginal area or space above or below the defogger heater element for disposition of an antenna, and furthermore the rear windows are disposed nearly vertical, though this similarly occurs even in case their rear windows are of the type incapable of opening and closing. Thus, antenna strips arranged at such a small and nearly vertical marginal space of the rear window glass cannot attain a sufficient reception gain. This is particularly pronounced in case of antenna strips for receiving AM radio broadcast waves which are of low frequency and FM radio broadcast waves. Thus, an antenna provided to a side window glass for receiving radio broadcast waves has been demanded recently, but there have been little proposals to such an antenna.

Furthermore, for receiving ultrashort waves such as FM radio broadcast waves, it is a usual practice to dispose a plurality of antennas in predetermined places and switch the connections of the antennas selectively so that the ultrashort waves are received by one of the antennas which can attain a higher reception gain than any other antennas. In such diversity reception, even such an antenna which effects a particular drop or fall of gain (i.e., a so-called dip) in a particular direction, i.e., which exhibits a sharp directivity when used alone can be used. However, such an antenna cannot be used alone for reception of FM radio broadcast waves other than for diversity reception.

SUMMARY OF THE INVENTION

According to an aspect of the present invention, there is provided a novel and improved glass antenna attached to a vehicle side window glass for receiving radio waves, the window glass having a pair of vertically opposed upper and lower edges and a pair of horizontally opposed lateral edges, the glass antenna comprising a feed point disposed adjacent one of the lateral edges of the window glass, a first vertical element extending upwardly from the feed point along one of the lateral edges to a place adjacent the upper edge of the window glass, a first horizontal element extending from the first vertical element along the upper edge to a nearly central portion of the window glass, a second vertical element extending from the first horizontal element through the nearly central portion to a place adjacent the lower edge of the window glass, a second horizontal element extending from the second vertical element along the lower edge to a place adjacent the other of the lateral edges, and a third vertical element extending upwardly from the second horizontal element along the other of the lateral edges.

According to another aspect of the present invention, the glass antenna further comprises a third horizontal element having a bent shape and consisting of a pair of horizontal conductive strips and a vertical conductive strip, the third horizontal element connecting between the first horizontal element and the second vertical element.

According to a further aspect of the present invention, all of the horizontal and vertical elements are constituted by a single conductive strip.

According to a further aspect of the present invention, at least part of the horizontal and vertical conductive strips constituted by a plurality of conductive strips.

According to a further aspect of the present invention, all of the horizontal and vertical conductive strips are constituted by a plurality of conductive strips, respectively.

According to a further aspect of the present invention, there is provided a glass antenna attached to a vehicle side window glass for receiving radio waves, the window glass having a pair of vertically opposed upper and lower edges and a pair of horizontally opposed lateral edges, the glass antenna comprising a feed point disposed at an upper corner of the window glass, a first horizontal element extending from the feed point along the upper edge to a nearly central portion of the window glass, a first vertical element extending from the first horizontal element trhough the nearly central portion to a place adjacent the lower edge of the window glass, a second horizontal element extending from the first vertical element along the lower edge to a place adjacent the other of the lateral edges, and a second vertical element extending from the second horizontal element along the other of the lateral edges.

According to a further aspect of the present invention, the glass antenna further comprises a third vertical element having a bent shape and consisting of a pair of vertical conductive strips and a horizontal conductive strip, the third vertical element connecting between the feed point and the first horizontal element.

According to a further aspect of the present invention, there is provided a glass antenna attached to a vehicle side window glass for receiving radio waves, the window glass having a pair of vertically opposed upper and lower edges and a pair of horizontally opposed lateral edges, the glass antenna comprising a feed point disposed adjacent one of the lateral edges of the window glass, a first vertical element extending downwardly from the feed point along the one lateral edge to a place adjacent the lower edge of the window glass, a first horizontal element extending from the first vertical element along the lower edge to a nearly central portion of the window glass between the lateral edges, a second vertical element extending upwardly from the first horizontal element through the nearly central portion to a place adjacent the upper edge of the window glass, a second horizontal element extending from the second vertical element along the upper edge to a place adjacent the other of the lateral edges, and a third vertical element extending downwardly from the second horizontal element along the other of the lateral edges.

According to a further aspect of the present invention, there is provided a glass antenna attached to a vehicle side window glass for receiving radio waves, the window glass having a pair of vertically opposed upper and lower edges and a pair of horizontally opposed lateral edges, the glass antenna comprising a feed point disposed at a lower corner of the window glass, a first horizontal element extending from the feed point along the lower edge to a nearly central portion of the window glass, a first vertical element extending upwardly from the first horizontal element through the nearly central portion to a place adjacent the upper edge of the window glass, a second horizontal element extending from the first vertical element along the upper edge to a place adjacent the other of the lateral edges, and a second vertical element extending downwardly from the second horizontal element along the other of the lateral edges.

In this specification, the term "vertical" is used in the sense of "directed upwardly and downwardly" on the window glass, so a vertical element or strip is not literally vertical. Similarly, the term "horizontal" is used in the sense of "directed laterally", so a horizontal element or strip is not literally horizontal.

An important feature of the present invention, as will be seen from the embodiment shown in FIG. 1, resides in that the first vertical element and the first horizontal element are disposed along the peripheral edges of the window glass, the second vertical element is disposed at nearly central portion of the window glass and the third vertical element is disposed along the peripheral edge of the window glass so that the antenna has an S-shaped pattern when observed on the window glass which is rotated 90 degrees. The element having a bent shape or -shape may be provided adjacent the feed point or at an intermediate portion of the antenna as in the embodiments shown in FIGS. 3 to 5 for increasing the total length of the antenna. In such a case, the first vertical element can be omitted.

Further, in case the window glass is large-sized or the receive frequency is relatively high as the FM radio broadcast waves in Europe and America (88 to 108 MHz band), one vertical strip can be omitted so that the antenna includes only two vertical elements as in the embodiments shown in FIGS. 6 and 8.

It is preferable that the first vertical element, the third vertical element, the first horizontal element and the second horizontal element are disposed along the peripheral edges of the window glass in a way as to be at least 10 mm distant from the edges so that the reception gain is not lowered by the influence of the vehicle metal body.

Further, the antenna may have an S-shaped pattern which is entirely doubled as in the embodiment shown in FIG. 4 or partly doubled as in FIG. 2.

The antenna of this invention having an S-shaped pattern when observed on the window glass which is rotated 90 degrees can have a larger length as compared with an E-shaped pattern consisting of three parallel strips disposed adjacent upper and lower edges and at a central portion therebetween and a vertical strip adjacent one lateral edge connecting the ends of the parallel strips or a pattern having a strip extending one time around the window glass, and thus can attain a higher reception gain for AM radio broadcast waves and FM radio broadcast waves. Further, by the effect of the vertical strip disposed at the central portion of the window glass, the antenna of this invention can have a larger effective receiving area as compared with the antenna of the pattern having a strip extending one time around the periphery of the window glass. Further, the antenna of this invention having a partly or entirely doubled strip arrangement can further increase the effective receiving area, thus making it possible not only to improve the reception gain for the AM radio broadcast waves but to receive with good sensitivity long waves of 144 to 288 KHz band in Europe and short waves.

Further, in order to improve the reception gain particularly for FM radio broadcast waves or to improve the directional characteristics or to adjust the impedance, the antenna of this invention can be provided with various additional elements consisting of a horizontal strip or vertical strip, or having an L-shape, T-shape, -shape or the like made up of a combination of horizontal and vertical strips. For receiving with good sensitivity FM radio broadcast waves, AM radio broadcast waves, long waves or short waves, the antenna of this invention may be additionally provided with an impedance matching circuit, pre-amplifier circuit or the like as an external circuit.

Further, the antenna of this invention can be provided to either of the left and right side windows and can receive only by itself and with good sensitivity AM radio broadcast waves and FM radio broadcast waves. However, for receiving the FM radio broadcast waves, the antenna of this invention can, of course, be used together with another glass antenna for reception of FM radio broadcast waves provided to the other side window glass (in this instance, it is desirable to use an antenna of the structure of this invention but an antenna of the structure other than this invention can be used), a glass antenna for FM radio broadcast waves provided to a rear window glass, an antenna provided to a windshield or a pole antenna to carry out diversity reception.

The above structure of this invention can solve the above noted problems inherent in the prior art glass antenna.

It is accordingly an object of the present invention to provide a novel and improved glass antenna attached to a vehicle side window glass for receiving radio waves which can attain improved directional characteristics and thereby can receive only by itself and with good sensitivity not only FM radio broadcast waves but AM radio broadcast waves, long waves and short waves.

DETAILED DESCRIPTION OF THE PREFERRED EMBODIMENT

Figure 1:
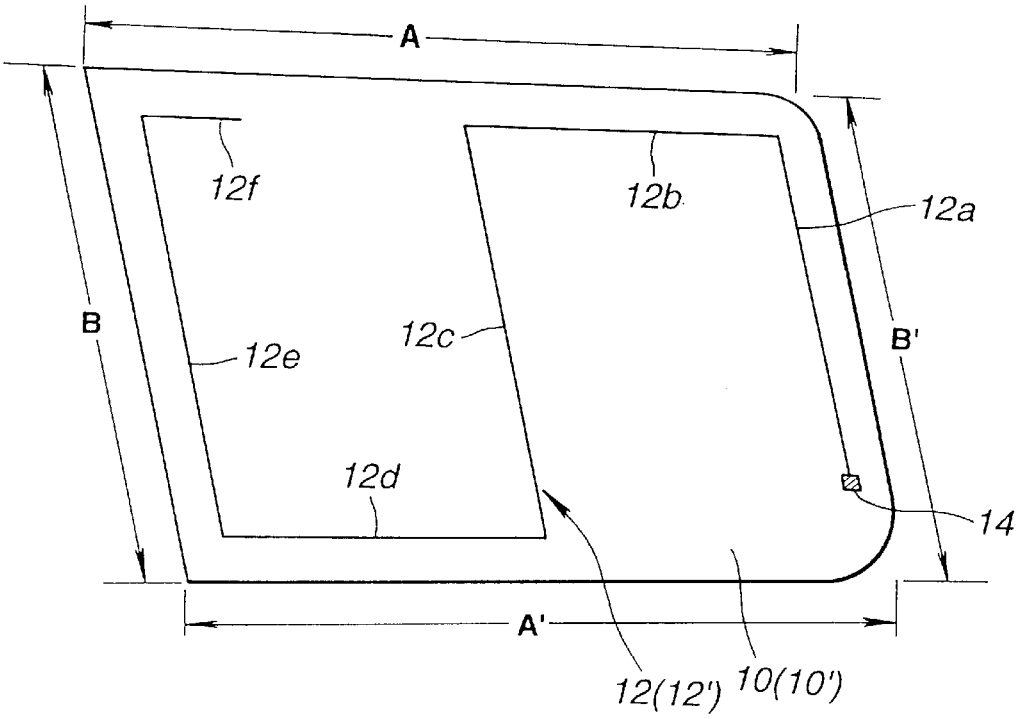
FIG. 1 is an elevational view of an antenna provided to an automotive side window glass on one side of an automotive vehicle according to the first embodiment of the present invention, which is taken from the outside of the vehicle.

FIG. 1 shows an automobile side window glass in which the present invention is embodied. A single piece of glass plate 10 is used as the window glass. A glass antenna 12 for receiving AM radio broadcast waves and FM radio broadcast waves according an embodiment of the present invention is installed on an inboard surface of the glass plate 10. The glass antenna 12 has an S-like pattern when observed on the glass plate 10 which is rotated 90 degrees so that the left-hand and right-hand lateral edges of the glass plate 10 oppose vertically. The glass antenna 12 includes a feed point 14, a first vertical strip 12*a* of the length of 320 mm extending upwardly from the feed point 14 along a right-hand lateral edge of the glass plate 10, a first horizontal strip 12*b* of the length of 330 mm extending along an upper edge of the glass plate 10 to a nearly widthwise central region of the glass plate 10 (i.e., the nearly central region of the glass plate 10 between the left-hand and the right-hand edges thereof), a second vertical strip 12*c* of the length of 370 mm extending downwardly along the nearly widthwise central region of the glass plate 10, a second horizontal strip 12*d* of the length of 330 mm extending along a lower edge of the glass plate 10 to the left-hand lateral edge of the glass plate 10 which is opposite to the first vertical strip 12*a*, a third vertical strip 12*e* of the length of 370 mm extending upwardly along the left-hand lateral edge of the glass plate 10, and a third horizontal strip 12*f* which is short, i.e., of the length of 100 mm.

The first vertical strip 12*a*, first horizontal strip 12*b*, second vertical strip 12*c*, second horizontal strip 12*d*, third vertical strip 12*e* and third horizontal strip 12*f* constitute a first vertical main antenna element, first horizontal main antenna element, second vertical main antenna element, second horizontal main antenna element, third vertical main antenna element and third horizontal main antenna element, respectively.

The glass antenna 12 is formed by screen printing a conductive paste onto the glass surface and baking the printed paste simultaneously with the bending process of the glass plate 10.

Figure 9:
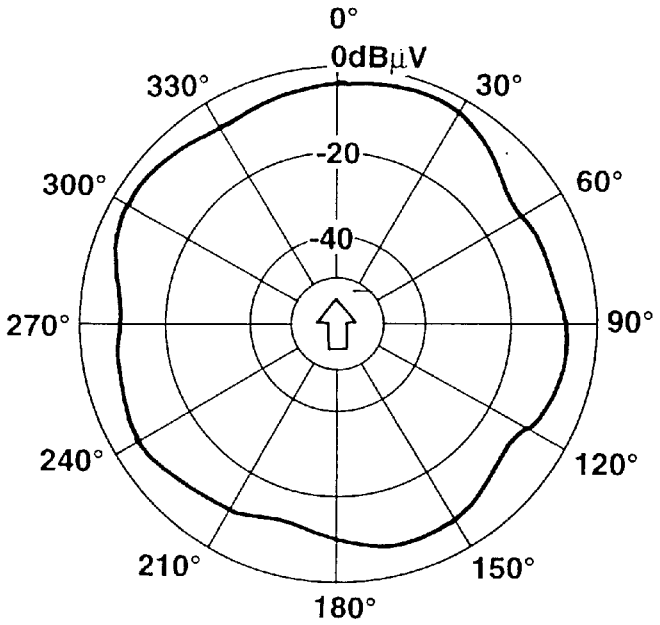
FIG. 9 is a diagram of a directional characteristic of the antenna of FIG. 1 for FM radio broadcast waves of 84 MHz.
Figure 10:
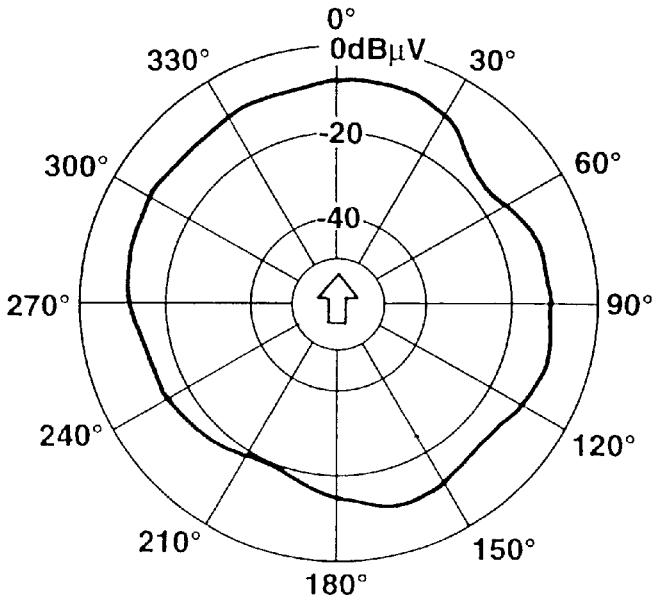
FIG. 10 is a diagram of a directional characteristic of the antenna of FIG. 1 for FM radio broadcast waves of 98 MHz.

The glass plate 10 has such dimensions that A=630 mm, A'=630 mm, B=450 mm and B'=430 mm. Measurement of the directional characteristics of the glass antenna 12 for broadcast waves of the frequency of 84 MHz which is nearly the center frequency of the FM radio broadcast band in Japan and FM broadcast waves of the frequency of 98 MHz which is nearly the center frequency of the FM broadcast band in Europe and America was made. The measured directional characteristics are respectively shown in FIGS. 9 and 10.

As will be apparent from this result, the directional characteristics have little drop or fall of reception gain (i.e., dip) resulting due to the difference in the direction of transmission of a broadcast wave, and therefore it will be seen that the glass antenna 12 has quite good directional characteristics.

Figure 11:
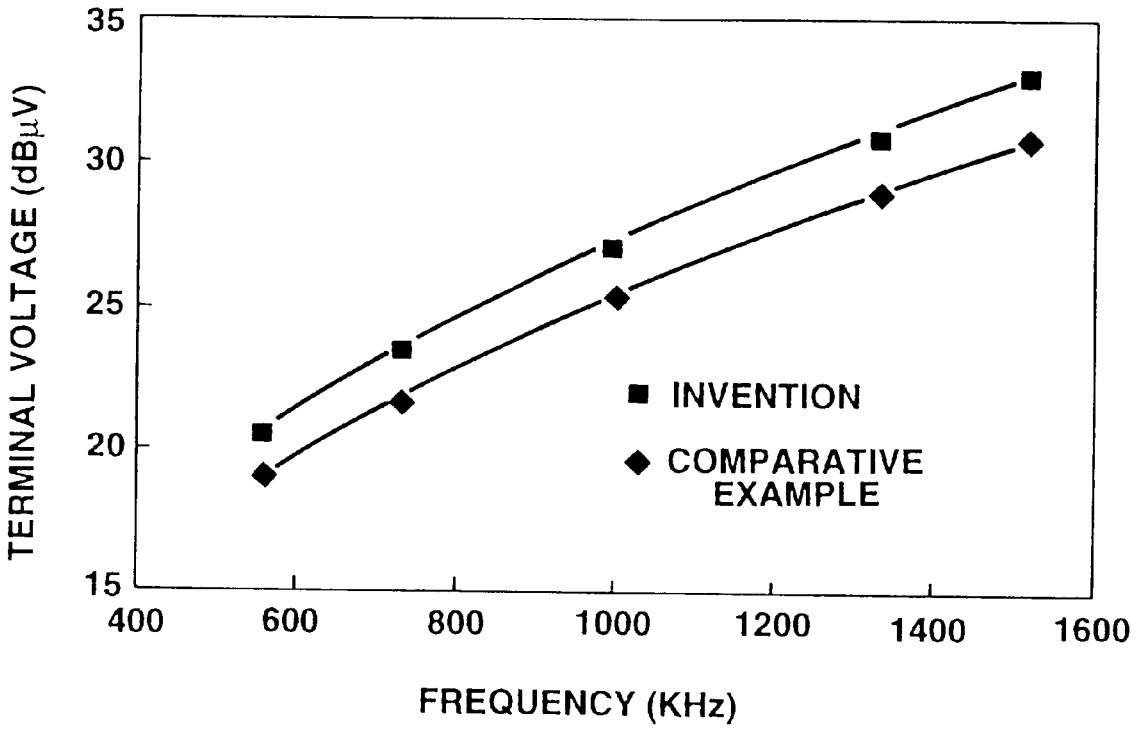
FIG. 11 is a graph of terminal voltages of the antenna of FIG. 1 and an antenna of a comparative example for AM radio band waves.

Further, another glass antenna 12' was provided to a window glass 10' on the other side of the automotive vehicle, and measurement of the receiving ability or sensitivity of the glass antenna 12' for AM radio broadcast waves of the frequency band from 530 to 1600 KHz was made. The measured sensitivity is depicted in terminal voltage in FIG. 11. By the comparison with an antenna consisting of a conductive strip which extends from a feed point at a corner of a glass plate of the same dimensions as the window glass 10, one time around the peripheral portion of the window glass (hereinafter referred to as a comparative example), it will be seen that the glass antenna 12' has an improved sensitivity by about 2 dB and is thus better than the comparative example.

Figure 2:
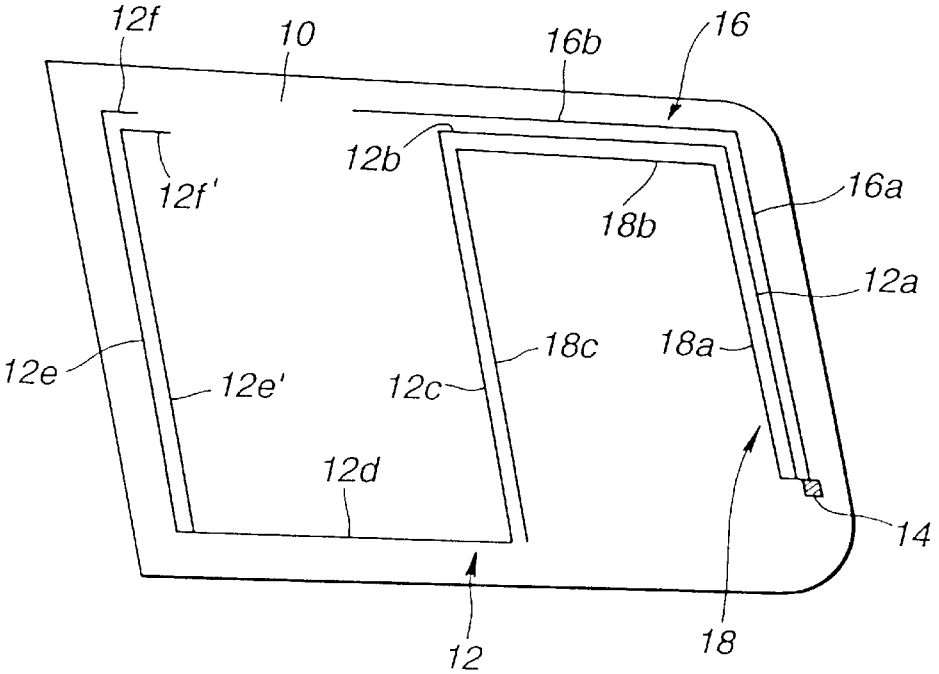
FIGS. 2 to 8 are views similar to FIG. 1 but show antennas according to the second to eighth embodiments of the present invention, respectively.

FIG. 2 shows a modification of the glass antenna shown in FIG. 1. In the embodiment shown in FIG. 2, the first vertical strip 12*a*, the first horizontal strip 12*b*, the second vertical strip 12*c* and the second horizontal strip 12*d* have the same structure and dimensions as those of the embodiment shown in FIG. 1. In parallel with the third vertical strip 12*e* (370 mm long) and the third horizontal strip 12*f* (50 mm long), an additional vertical strip 12*e*' (350 mm long) and additional horizontal strip 12*f*' (80 mm long) are respectively provided so that the third vertical main antenna element and the third horizontal main element are respectively made up of conductive strips which are provided double, i.e., are respectively constituted by a plurality of conductive strips. There is provided an auxiliary element 16 consisting of a vertical strip 16*a* of the length of 340 mm extending along the first vertical strip 12*a* and a horizontal strip 16*b* of the length of 400 mm extending along the first horizontal strip 12*b*. There is further provided an auxiliary element 18 consisting of a vertical strip 18*a* of the length of 300 mm extending along the first vertical strip 12*a*, a horizontal strip 18*b* of the length of 300 mm extending along the first horizontal strip 12*b*, and a vertical strip 18*c* of the length of 350 mm extending along the second vertical strip 12*c*.

Figure 3:
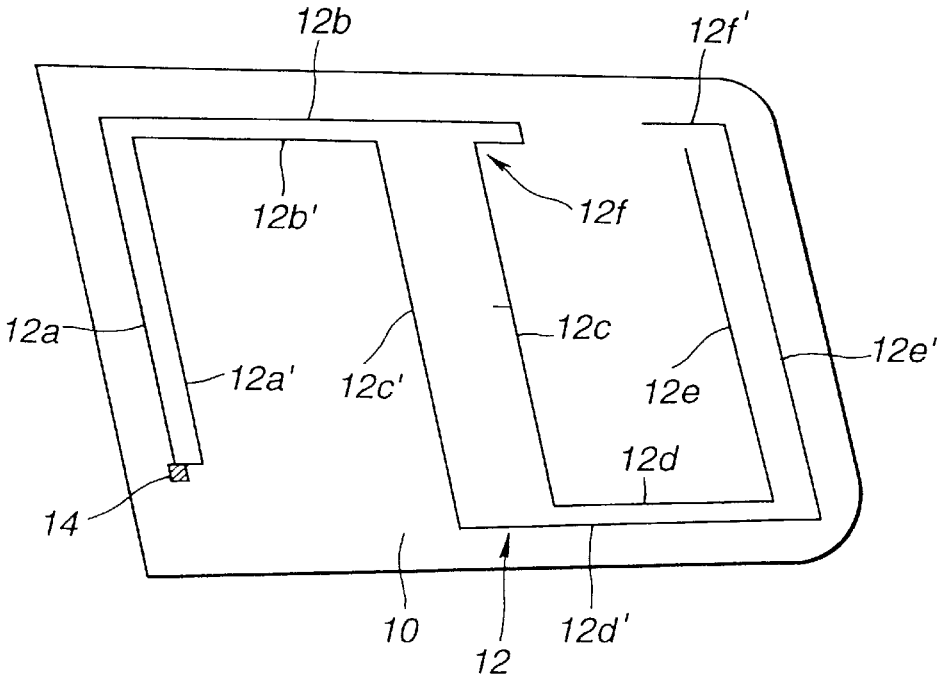

FIG. 3 shows another modification of the glass antenna shown in FIG. 1. In the embodiment shown in FIG. 3, the feed point 14 is disposed at the lower left-hand corner of the glass plate 10. The first vertical strip 12*a* of the length of 320 mm extends along the left-hand lateral edge of the glass plate 10. The first horizontal strip 12*b* is a little lengthened so as to be 380 mm long, whereas the second vertical strip 12*c* is a little shortened so as to be 350 mm long. The third horizontal strip 12*f* has a bent shape and connects between the first horizontal strip 12*b* and the second vertical strip 12*c* . The third horizontal strip 12*f* is made up of a pair of parallel horizontal parts of the length of 70 mm and a vertical part of the length of 20 mm. The second horizontal strip 12*d* is shortened so as to be 250 mm. The third vertical strip 12*e* is shortened so as to be 350 mm long. The antenna 12 further includes an additional first vertical strip 12*a*' of the length of 300 mm extending along the first vertical strip 12*a*, an additional first horizontal strip 12*b*' extending along the first horizontal strip 12*b* and located inside of same, an additional second vertical strip 12*c*' of the length of 350 mm extending along the second vertical strip 12*c*, an additional second horizontal strip 12*d*' of the length of 390 mm extending along the second horizontal strip 12*d*, an additional third vertical strip 12*e*' of the length of 370 mm extending along the third vertical strip 12*e*, and an additional third horizontal strip 12*f*' of the length of 80 mm located adjacent the upper free end of the third vertical strip 12*e*. Thus, the antenna 12 of this embodiment has a doubled pattern, i.e., the first vertical antenna element, first horizontal antenna element, second vertical antenna element, second horizontal antenna element and third vertical antenna element are respectively constituted by two conductive strips, i.e., by the first vertical strips 12*a* and 12*a*', first horizontal strips 12*b* and 12*b*', second vertical strips 12*c* and 12*c*', second horizontal strips 12*d* and 12*d*' and third vertical strips 12*e* and 12*e*'.

Figure 4:
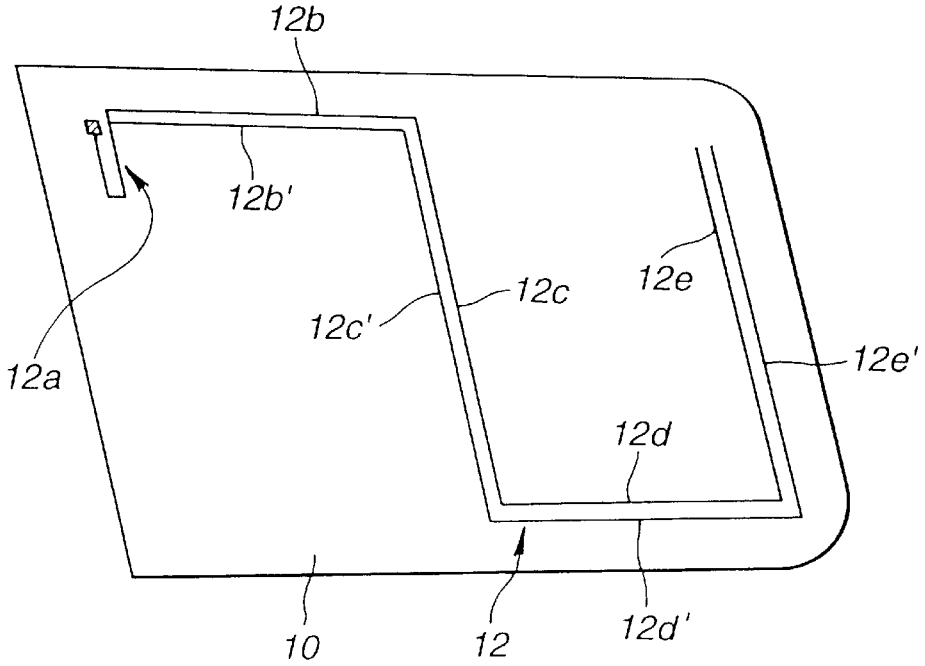

FIG. 4 shows another modification of the antenna 12 shown in FIG. 1. In the embodiment shown in FIG. 4, the feed point 14 is disposed at the upper left-hand corner of the glass plate 10. The first vertical strip 12*a* is shortened and has a U-like bent shape so as to extend downwardly from the feed point 14 and is then bent upwardly to be connected to the first horizontal strip 12*b*. The antenna 12 further includes an additional first horizontal strip 12*b*' extending along the first horizontal strip 12*b*, an additional second vertical strip 12*c*' extending along the second vertical strip 12*c*, an additional second horizontal strip 12*d*' extending along the second horizontal strip 12*d* and an additional third vertical strip 12*e*' extending along the third vertical strip 12*e*. Thus, in this embodiment, the conductive strips are partly arranged double; That is, the first horizontal antenna element, second vertical antenna element, second horizontal antenna element and third vertical antenna element are respectively constituted by two conductive strips, i.e., by the first horizontal strips 12*b* and 12*b*', the second vertical strips 12*c* and 12*c*', the second horizontal strips 12*d* and 12*d*' and the third vertical strips 12*e* and 12*e*'.

Figure 5:
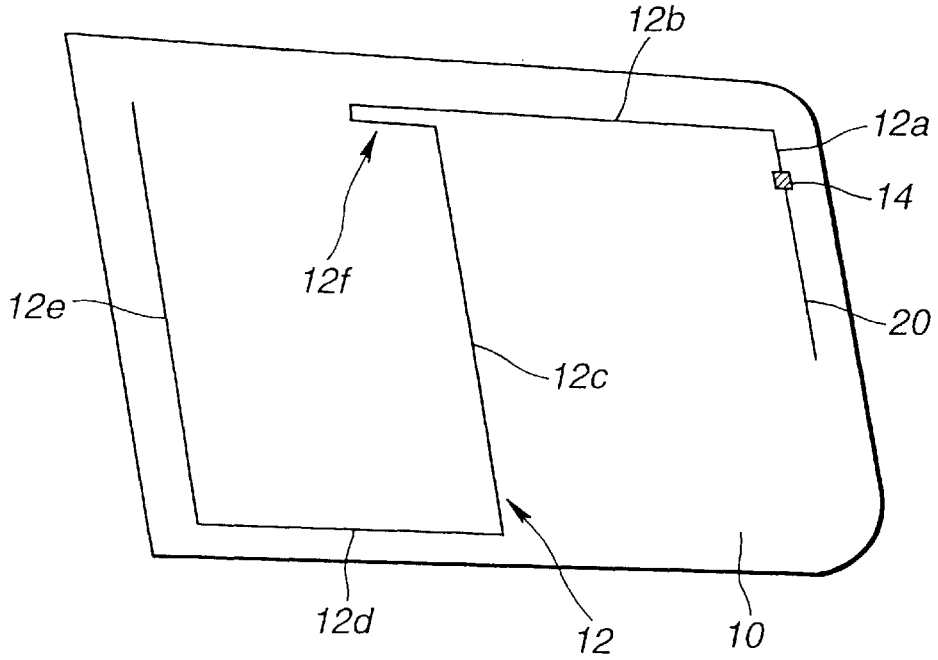

FIG. 5 shows a modification of the antenna 12 shown in FIG. 1. In this embodiment, the feed point 14 is disposed at the upper right-hand corner of the glass plate 10. The first vertical strip 12*a* which is quite short so almost incapable of serving as an antenna but as a lead wire, extends upwardly from the feed point 14. The third horizontal strip 12*f* has a bent shape and connects between the first horizontal strip 12*b* and the second vertical strip 12*c*. The antenna 12 further includes an auxiliary antenna element 20 extending downwardly from the feed point 14.

Figure 6:
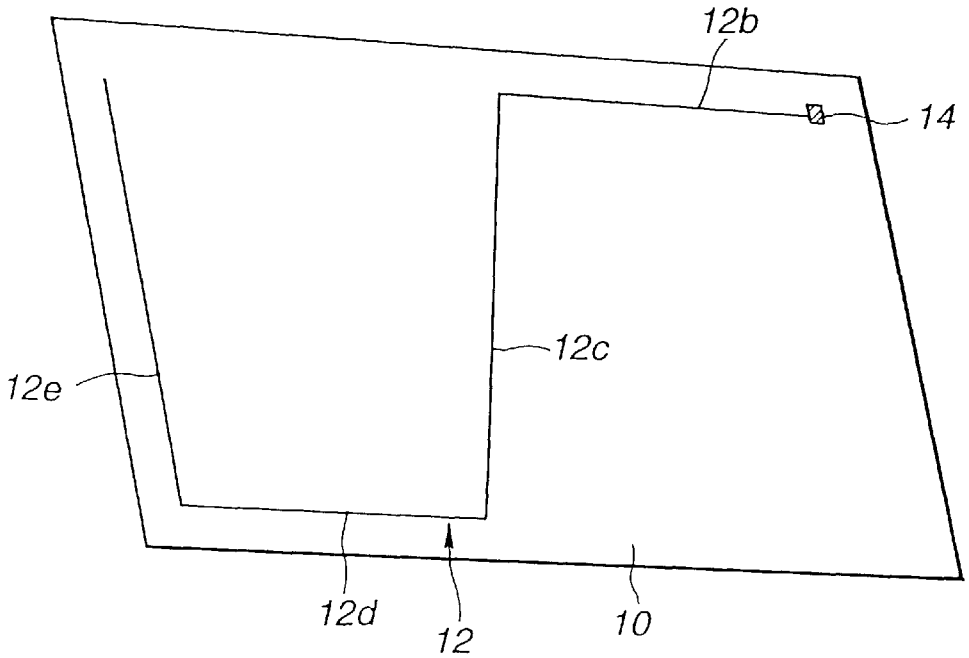

FIG. 6 shows a modification of the antenna shown in FIG. 1. In this embodiment, the feed point 14 is disposed at the upper right-hand corner of the glass plate 10. The first vertical strip and the third horizontal strip in the embodiment shown in FIG. 1 are omitted since the glass plate 10 in this embodiment is large-sized than that in the embodiment shown in FIG. 1 so the first horizontal strip 12*b*, the second vertical strip 12*c*, the second horizontal strip 12*d* and the third vertical strip 12*e* can be lengthened respectively. Since the first horizontal strip 12*b*, the second vertical strip 12*c*, the second horizontal strip 12*d* and the third vertical strip 12*e* can be set longer, the antenna 12 of this embodiment can be constituted by only four conductive strips or antenna elements, i.e., first and second horizontal antenna elements, and first and second vertical antenna elements. The first and second vertical antenna elements are constituted by the second and third vertical conductive strips 12*c* and 12*d*, respectively.

Figure 7:
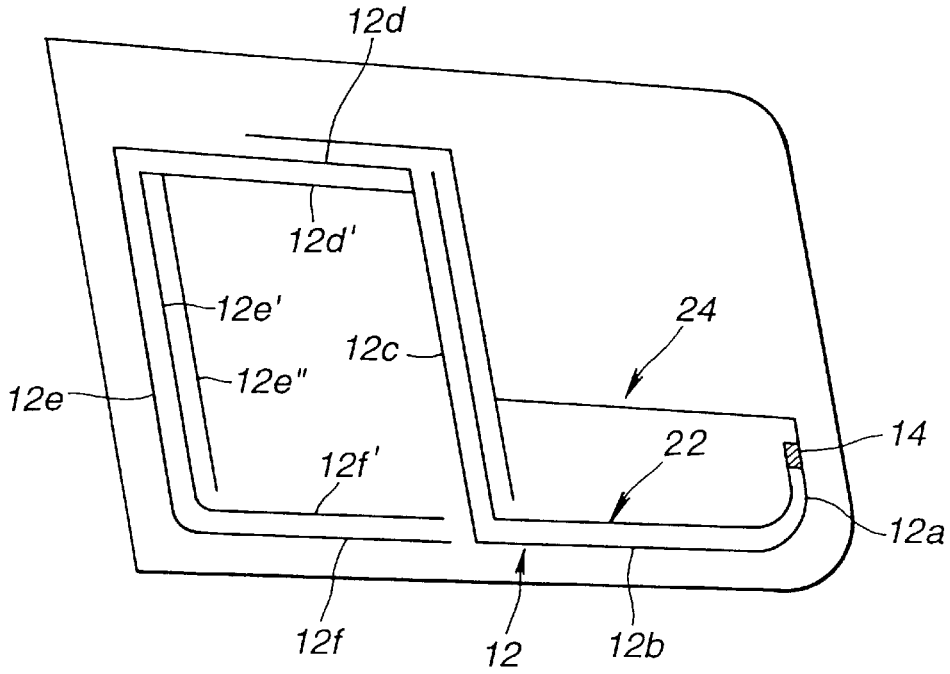

FIG. 7 shows a further modification of the antenna shown in FIG. 1. In this embodiment, the first vertical strip 12*a* is shortened and extends downwardly from the feed point 14. The first horizontal strip 12*b* disposed adjacent the lower edge of the glass plate 10, whereas the second horizontal strip 12*d* is disposed adjacent the upper edge of the glass plate 10. The antenna 12 further includes an additional second horizontal strip 12*d*', additional third vertical strips 12*e*' and 12*e*", and an additional third horizontal strip 12*f*'. Thus, in this embodiment, the second horizontal antenna element and the third horizontal antenna element are respectively constituted by two conductive strips, i.e., by conducive strips which are provided double, whereas the third vertical antenna element is constituted by three conductive strips, i.e., by conductive strips which are provided triple. The antenna 12 further includes auxiliary antenna elements 22 and 24.

Figure 8:
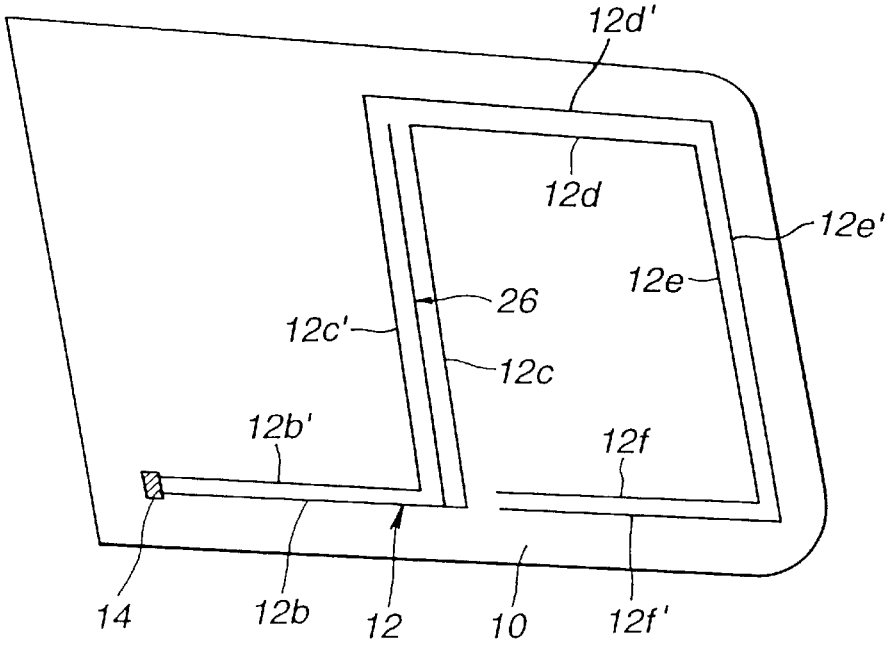

FIG. 8 shows a further modification of the antenna shown in FIG. 1. In this embodiment, the feed point 14 is disposed at the lower left-hand corner of the glass plate 10. The first horizontal strip 12*b* extends from the feed point 14 along the lower edge of the glass plate 10. The second horizontal strip 12*d* extends from the second vertical strip 12*c* along the upper edge of the window glass 10, whereas the third horizontal strip 12*f* extends from the third vertical strip 12*e* along the lower edge of the window glass 10. The first vertical strip 12*a* in the embodiment shown in FIG. 1 is omitted, and in place therefor the antenna 12 is provided with an additional first horizontal strip 12*b*' extending along the first horizontal strip 12*b*, an additional second vertical strip 12*c*' extending along the second vertical strip 12*c*, an additional second horizontal strip 12*d*' extending along the second horizontal strip 12*d*, an additional third vertical strip 12*e*' extending along the third vertical strip 12*e* and an additional third horizontal strip 12*f*' extending along the third horizontal strip 12*f*. The antenna 12 further includes an auxiliary element 26 extending vertically from the first horizontal element 12*b* along the second vertical element 12*c*. Thus, in this embodiment, the first and second vertical antenna elements are constituted by the second vertical conductive strips 12*c* and 12*c*' and third vertical conductive strips 12*e* and 12*e*', respectively. That is, the first and second antenna elements are constituted by two conductive strips which are provided double. Further, the first, second and third horizontal antenna elements are also constituted by two conductive strips which are provided double, i.e., by the conductive strips 12*b* and 12*b*', 12*d* and 12*d*', and 12*f* and 12*f*', respectively.

By the experiments conducted by the applicants, it was recognized that the embodiments shown in FIGS. 5 and 6 could have or possess substantially the same sensitivity for AM radio broadcast waves and FM radio broadcast waves as that of the antenna shown in FIG. 1 and the embodiments shown in FIGS. 2, 3, 4, 7 and 8 could have or possess the better sensitivity for AM radio broad cast waves and FM broadcast waves than that of the antenna shown in FIG. 1.

From the foregoing, it will be understood that the antenna according to the present invention makes it possible not only to receive FM radio broadcast waves and AM radio broadcast waves with high reception gain but to receive long and short radio waves, particularly it exhibits nearly non-directivity for FM radio broadcast waves so it can successfully receive FM radio broadcast waves only by itself.

What is claim is:

1. A glass antenna attached to a vehicle side window glass for receiving radio waves, the window glass having a pair of vertically opposed upper and lower edges and a pair of horizontally opposed lateral edges, the glass antenna comprising:

a feed point disposed adjacent one of the lateral edges of the window glass;

a first vertical element extending upwardly from said feed point along one of the lateral edges to a place adjacent the upper edge of the window glass;

a first horizontal element extending from said first vertical element along the upper edge to a nearly central portion of the window glass;

a second vertical element extending from said first horizontal element through said nearly central portion to a place adjacent the lower edge of the window glass;

a second horizontal element extending from said second vertical element along said lower edge to a place adjacent the other of the lateral edges; and a third vertical element extending upwardly from said second horizontal element along the other of the lateral edges.

2. A glass antenna according to claim 1, further comprising a third horizontal element having a bent shape and consisting of a pair of horizontal conductive strips and a vertical conductive strip.

3. A glass antenna according to claim 2, wherein said third horizontal element is provided between said first horizontal element and said second vertical element.

4. A glass antenna according to claim 1, wherein all of said horizontal and vertical elements are constituted by a single conductive strip.

5. A glass antenna according to claim 1, wherein at least part of said horizontal and vertical conductive strips is constituted by a plurality of conductive strips.

6. A glass antenna according to claim 1, wherein all of said horizontal and vertical conductive strips are constituted by a plurality of conductive strips, respectively.

7. A glass antenna attached to a vehicle side window glass for receiving radio waves, the window glass having a pair of vertically opposed upper and lower edges and a pair of horizontally opposed lateral edges, the glass antenna comprising:

a feed point disposed at an upper corner of the window glass;

a first horizontal element extending from said feed point along the upper edge to a nearly central portion of the window glass;

a first vertical element extending from said first horizontal element through said nearly central portion to a place adjacent the lower edge of the window glass;

a second horizontal element extending from said first vertical element along the lower edge to a place adjacent the other of the lateral edges; and a second vertical element extending from said second horizontal element along the other of the lateral edges.

8. A glass antenna according to claim 7, further comprising a third vertical element having a bent shape and consisting of a pair of vertical conductive strips and a horizontal conductive strip.

9. A glass antenna according to claim 8, wherein said third vertical element is provided between said feed point and said first horizontal element.

10. A glass antenna according to claim 7, wherein all of said horizontal and vertical elements are constituted by a single conductive strip.

11. A glass antenna according to claim 7, wherein at least part of said horizontal and vertical elements is constituted by a plurality of conductive strips.

12. A glass antenna according to claim 7, wherein all of said horizontal and vertical elements are constituted by a plurality of conductive strips, respectively.

13. A glass antenna attached to a vehicle side window glass for receiving radio waves, the window glass having a pair of vertically opposed upper and lower edges and a pair of horizontally opposed lateral edges, the glass antenna comprising:

a feed point disposed adjacent one of the lateral edges of the window glass;

a first vertical element extending downwardly from said feed point along one of the lateral edges to a place adjacent the lower edge of the window glass;

a first horizontal element extending from said first vertical element along the lower edge to a nearly central portion of the window glass;

a second vertical element extending upwardly from said first horizontal element through the nearly central portion to a place adjacent the upper edge of the window glass;

a second horizontal element extending from said second vertical element along the upper edge to a place adjacent the other of the lateral edges; and a third vertical element extending downwardly from said second horizontal element along the other of the lateral edges.

14. A glass antenna according to claim 13, wherein at least part of said horizontal and vertical elements is constituted by a plurality of conductive strips.

15. A glass antenna according to claim 13, further comprising a third horizontal strip extending from said second vertical strip along the lower edge of the window glass to the nearly central portion of the window glass.

16. A glass antenna attached to a vehicle side window glass for receiving radio waves, the window glass having a pair of vertically opposed upper and lower edges and a pair of horizontally opposed lateral edges, the glass antenna comprising:

a feed point disposed at a lower corner of the window glass;

a first horizontal element extending from said feed point along the lower edge to a nearly central portion of the window glass;

a first vertical element extending upwardly from said first horizontal element through the nearly central portion to a place adjacent the upper edge of the window glass;

a second horizontal element extending from said first vertical element along the upper edge to a place adjacent the other of the lateral edges; and a second vertical element extending downwardly from said second horizontal element along the other of the lateral edges.

17. A glass antenna according to claim 16, wherein at least part of said horizontal and vertical elements is constituted by a plurality of conductive strips.

18. A glass antenna according to claim 16, further comprising a third horizontal strip extending from said second vertical strip along the lower edge of the window glass to the nearly central portion of the window glass.

* * * * *